US005598195A

United States Patent [19]

Okamoto et al.

[11] Patent Number: 5,598,195

[45] Date of Patent: Jan. 28, 1997

[54] INK JET RECORDING METHOD

[75] Inventors: Toru Okamoto; Susumu Hirakata, both of Ebina, Japan

[73] Assignee: Fuji Xerox Co., Ltd., Tokyo, Japan

[21] Appl. No.: 267,029

[22] Filed: Jun. 21, 1994

[30] Foreign Application Priority Data

Jun. 22, 1993 [JP] Japan ..... 5-150119

[51] Int. Cl.[6] ..... B41J 2/06

[52] U.S. Cl. ..... 347/55; 347/88

[58] Field of Search ..... 347/20, 55, 88, 347/99, 100, 103, 125

[56] References Cited

U.S. PATENT DOCUMENTS

| | | | |
|---|---|---|---|
| 3,653,932 | 4/1972 | Berry et al. | 347/99 X |
| 3,715,219 | 2/1973 | Kurz et al. | 347/99 X |
| 4,799,068 | 1/1988 | Saito et al. | 347/55 |
| 5,235,350 | 8/1993 | Lin et al. | 347/88 |
| 5,471,233 | 11/1995 | Okamoto et al. | 347/103 |

FOREIGN PATENT DOCUMENTS

| | | | |
|---|---|---|---|
| 56-167475 | 12/1981 | Japan | 347/55 |
| 62-41275 | 2/1987 | Japan . | |
| 2-29474 | 1/1990 | Japan . | |
| 3-296570 | 12/1991 | Japan . | |
| 4-93258 | 3/1992 | Japan | 347/88 |

OTHER PUBLICATIONS

Dong Ho Choi et al.; "Continuous Gray-Scale Printing With The Electrohydrodynamic Ink-Jet Principle;" IS&T's Eighth International Congress on Advances in Non-Impact Printing Technologies (1992); pp. 334–339.

Dong Ho Choi et al.; "Continuous-Tone Color Prints By The Electrohydrodynamic Ink-Jet Method;" IS&T's Ninth International Congress on Advances in Non-Impact Printing Technologies (1993); pp. 298–301.

Susumu Ichinose et al.; "Solidstate Scanning Ink Jet Recording with Slit Type Head;" Journal of Institute of Telecommunications Engineers; 83/1 vol. J66-c No. 1; pp. 47–54.

*Primary Examiner*—Alrick Bobb
*Assistant Examiner*—Raquel Gordon
*Attorney, Agent, or Firm*— Oliff & Berridge

[57] ABSTRACT

The present invention provides an electrostatic attracting-type ink jet recording method by which an ink dot which has adhered to the recording medium or intermediate recording material can be prevented from affecting the drawing direction of the subsequently jetting ink, whereby an ink can be invariably allowed to jet onto a proper position to form an image with a high quality. An electrostatic attracting-type ink jet recording method is provided which comprises applying a voltage pulse across a recording electrode connected to a recording head and an opposing electrode disposed on the opposite side of a recording medium or intermediate recording material, whereby the resulting Coulomb's force causes an ink to jet onto said recording medium or intermediate recording material through an orifice in the recording head to form an image thereon, characterized in that the relaxation time of the ink calculated by multiplying the dielectric constant of the ink by the volume resistivity of the ink during the operation of ink jet recording is in the range of 0.01 to 2 times the ink jetting period.

6 Claims, 8 Drawing Sheets

INK JET RECORDING METHOD

FIELD OF THE INVENTION

The present invention relates to an electrostatic attracting-type ink jet recording method. More particularly, the present invention relates to an ink jet recording method by which an ink dot which has adhered to the recording medium or intermediate recording material can be prevented from affecting the drawing direction of the subsequently jetted ink as much as possible, and whereby an ink can be invariably allowed to fly onto a proper position to form a high quality image.

BACKGROUND OF THE INVENTION

An ink jet recording method has drawn public attention because it is a nonimpact recording process capable of directly recording on an ordinary paper at a high speed, thus providing high image quality while using an apparatus of simple construction. In particular, an electrostatic suction-type ink jet recording method ejects ink by an electrostatic Coulomb's force in response to an electric signal. According to this method, the structure of the recording head is simple. The recording head is designed to have a recording width corresponding to the width of the recording paper. Further, by modulating the pulse width, the dot diameter can be modulated to form an image with a multi-gradation. Electrostatic suction-type ink jet recording methods which have heretofore been proposed can be classified by the structure of recording head into the following groups: single-nozzle processes in which a single nozzle is mechanically scanned during recording; multi-nozzle processes in which a number of nozzles arranged corresponding to pixels are electronically and horizontally scanned during recording; slit jet processes in which a single partition-free slit opening, with in which recording electrodes are arranged corresponding to pixel, is electronically and horizontally scanned during recording; and thermal slit jet processes in which a portion of ink which has been heated and fluidized to have low viscosity corresponding to an image, is drawn by a uniform electric field.

In the electrostatic attracting-type ink jet recording method, a voltage pulse is applied across a recording electrode on the recording head and an opposing electrode positioned on the back side of a recording medium or intermediate recording material such as recording paper, whereby the resulting Coulomb's force causes ink in the recording head to jet towards the recording medium or intermediate recording material to form a dot thereon so that an image is eventually formed. During this process, the ink jets or flies towards the recording medium or intermediate recording material while drawing a thread.

However, the foregoing electrostatic attraction-type ink jet recording method is disadvantageous in that the drawing direction of the flying ink from the recording head onto the recording medium or intermediate recording material is deviated by some actions, making it impossible to ensure that an ink can fly onto a proper position on the recording medium or intermediate recording material to form a dot. This results in a marked deterioration of the quality of the image formed on the recording medium or intermediate recording material.

The inventors made extensive studies of this phenomenon. As a result, it has been found that the factor which has a great effect on the drawing direction of a flying ink is the dielectric constant of the ink and volume resistivity of the ink rather than the dielectric constant of the recording medium or intermediate recording material and/or resistivity thereof. In some detail, the charged condition of a dot formed by an ink which has jetted towards the recording medium or intermediate recording material affects the drawing direction of the subsequently flying ink. Thus, the drawing line of the subsequently flying ink is bent, deviating the position of the subsequently formed dot from the predetermined position. This results in a marked deterioration of the image quality.

The foregoing phenomenon will be further discussed below. Referring first to FIG. 1, when a predetermined voltage pulse is applied with a power supply 4 across a recording electrode 1 in a recording head and an opposing electrode 3 positioned on the back side of a recording medium 2 such as recording paper, an ink 6 in an orifice 5 in the recording head then jets towards the recording medium 2 while drawing a thread to form a dot *7a* thereon.

In this process, if the ink 6 has too high a resistivity, the drawing thread is cut, leaving a positive charge generated by electrostatic induction on the dot *7a*, a positive charge remains on the dot *7a* as shown in FIG. 2. If ink 6 is allowed to fly to form a subsequent dot *7b* under these conditions, the drawing thread for the subsequent dot *7b* runs against the positive charge on the dot *7a* and is bent away from the dot *7a* (i.e., is repelled by the dot *7a*) to form a dot *7b* in a position deviated from the predetermined position away from the dot *7a*.

On the other hand, if the ink 6 has too low a resistivity, no positive charge remains on the dot *7a* unlike the foregoing case as shown in FIG. 3. However, since the ink 5 has too low a resistivity, the dot *7a* induces an electric charge of the same polarity as the opposing electrode 3 positioned on the back side of the recording medium 2 (negative charge in this case) due to the influence of the opposing electrode 3. If an ink 6 is allowed to jet to form a subsequent dot *7b*, the drawing thread for the subsequent dot *7b* is attracted by the negative charge on the dot *7a* and is bent towards the dot *7a* to form a subsequent dot *7b* in a position deviated from the predetermined position close to the dot *7a*.

Thus, the effect of an ink dot on the drawing thread for the subsequent dot may be repulsion or attraction depending on the charged condition of the ink dot. As a result of experiments made by the inventors focusing on the relationship between the relaxation time calculated by multiplying the dielectric constant of the ink by the volume resistivity of the ink and the ink flying period, it was found that there is a region in which an ink dot which has been formed has no substantial effect on the drawing ink thread for the subsequent dot, making it possible to form the subsequent dot in a predetermined position and eventually form an image with a high quality. Thus, the present invention has been worked out.

SUMMARY OF THE INVENTION

It is therefore an object of the present invention to provide an electrostatic attracting-type ink jet recording method by which an ink dot which has adhered to the recording medium or intermediate recording material can be prevented from affecting the drawing direction of subsequently flying ink as much as possible, and whereby an ink can be invariably allowed to fly onto a proper position to form an image with a high quality.

These and other objects of the present invention will become more apparent from the following detailed description and examples.

The present invention provides an electrostatic attracting-type ink jet recording method which comprises applying a voltage pulse across a recording electrode connected to a recording head and an opposing electrode disposed on the opposite side of a recording medium or intermediate recording material, whereby the resulting Coulomb's force causes an ink to fly onto said recording medium or intermediate recording material through an orifice in said recording head to form an image thereon.

The invention is further characterized in that the relaxation time of said ink calculated by multiplying the dielectric constant of said ink by the volume resistivity of said ink during the operation of ink jet recording is in the range of 0.01 to 2 times the ink flying period.

BRIEF DESCRIPTION OF THE DRAWINGS

By way of example and to make the description more clear, reference is made to the accompanying drawings in which.

DETAILED DESCRIPTION OF THE INVENTION

The ink jet recording method to which the present invention can be applied may be any of single-nozzle process, multi-nozzle process, slit jet process and thermal slit jet process so far as it is an electrostatic attracting-type ink jet recording method. Further, the ink employable in the present invention may be any of hot-melt ink which stays solid at room temperature but is molten on heating to exhibit a reduced volume resistivity, oil ink and aqueous ink so far as it can be used in the electrostatic attracting-type ink jet recording method.

The foregoing ink jet recording method is preferably a hot-melt process by which a thermoplastic ink which stays solid at room temperature is hot-molten and then allowed to jet because this process enables the formation of dots without running on paper or permeating into paper to provide a high image definition.

In the ink jet recording method according to the present invention, the relaxation time of an ink means a decreasing rate of electric charge remaining on the ink. The relationship between the relaxation time of an ink calculated by multiplying the dielectric constant of the ink by the volume resistivity of the ink and the flying time of the ink during the operation of recording can be considered as follows:

Assuming that an initial electric charge $E_0$ is on a dot having a dielectric constant $\in$ and a volume resistivity of $\rho$, the electric charge $\in$ on the dot decays with time t according to the following equation:

$$E=E_0 \exp(-t/\in\rho).$$

Figure 1:
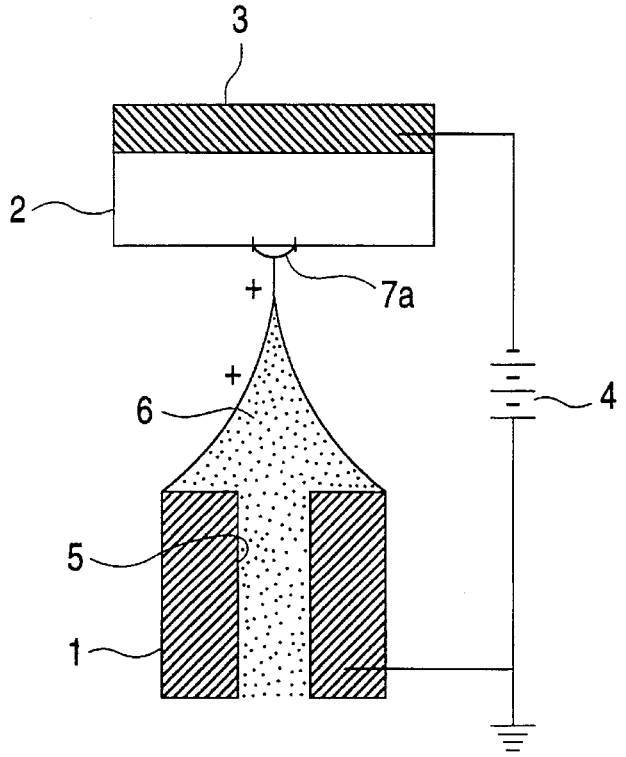
FIG. 1 PRIOR ART
FIG. 1 illustrates an ink dot and the drawing direction of the ink in a prior art electrostatic attracting-type ink jet recording method.
Figure 2:
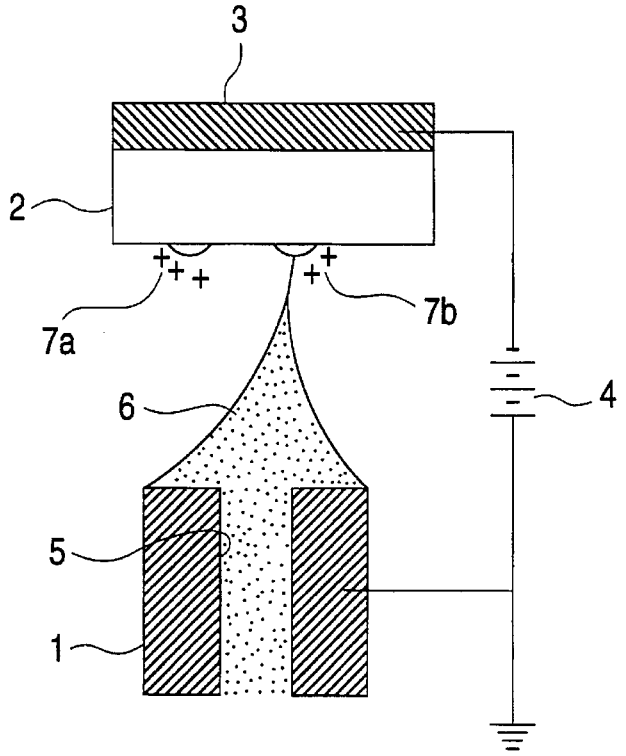
FIG. 2 PRIOR ART
FIG. 2 illustrates the relationship between an ink dot (a preceding ink dot) and the drawing direction of an ink for the subsequent dot in a prior art electrostatic attracting-type ink jet recording method.
Figure 3:
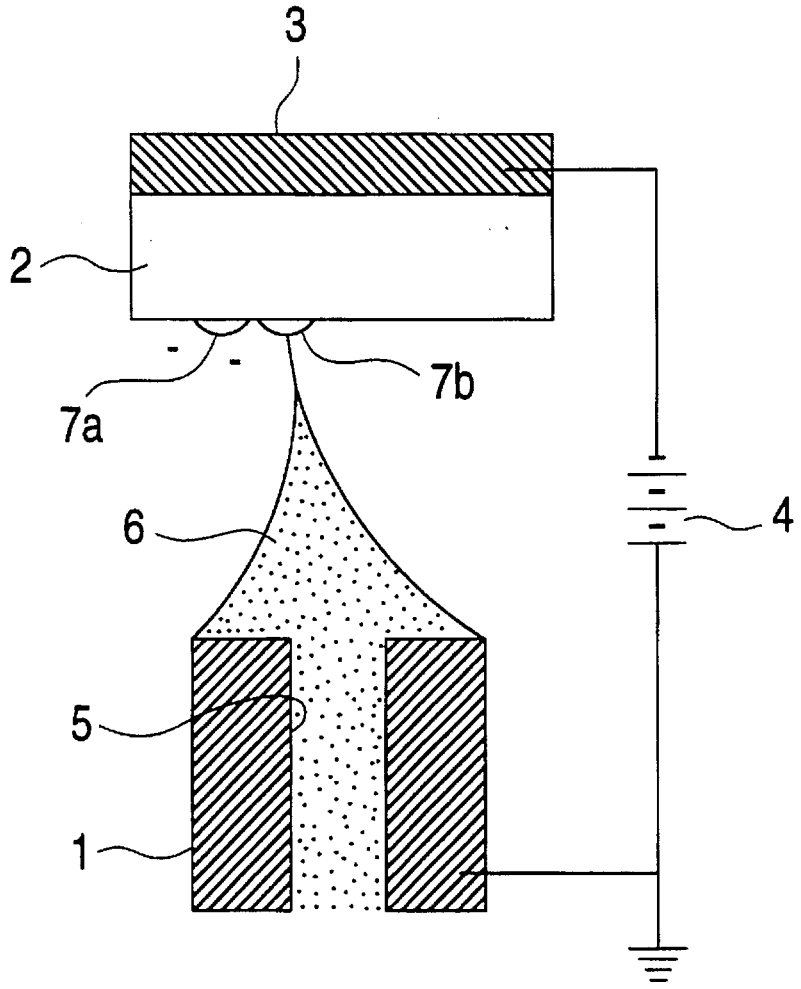
FIG. 3 PRIOR ART
FIG. 3 illustrates the relationship between an ink dot and the drawing direction of an ink for the subsequent dot in a prior art electrostatic attracting-type ink jet recording method.
Figure 4:
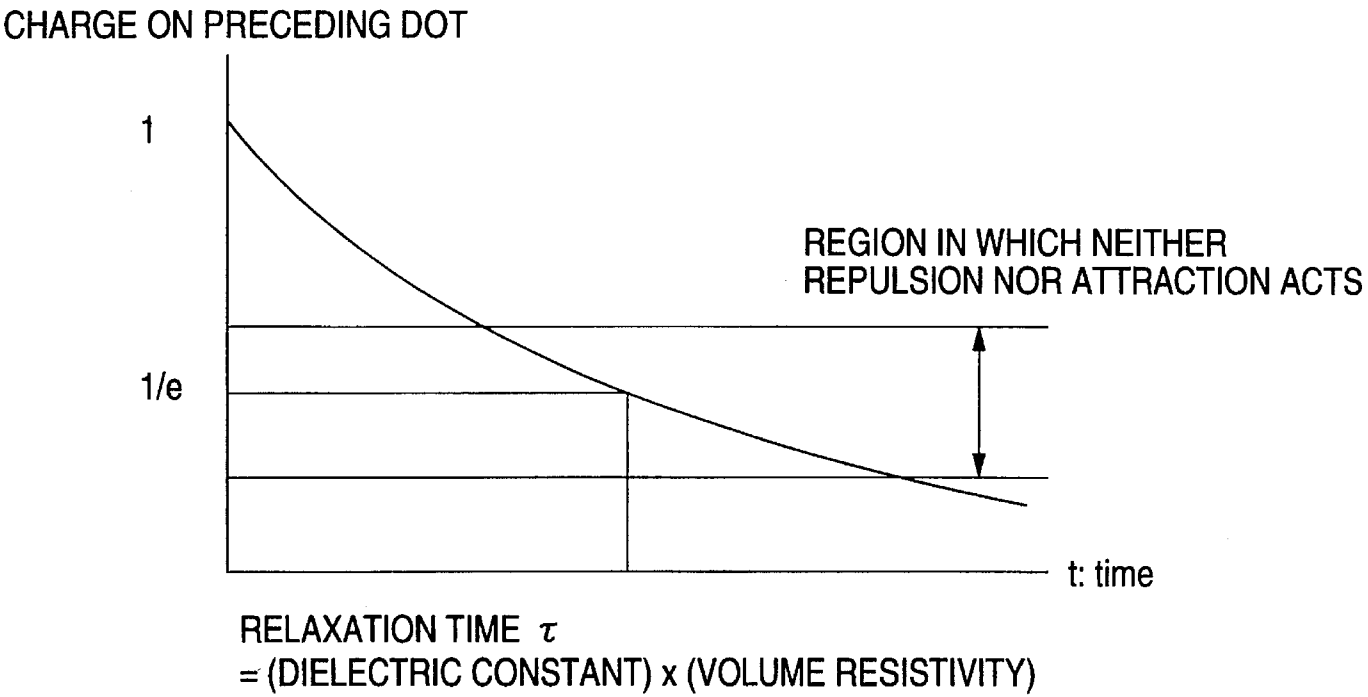
FIG. 4 is a graph illustrating the relationship between the relaxation time of an ink and the electric charge of the preceding ink dot.

Focusing our attention on the electric charge E on the dot, it has been found that there is a region of electric charge amount that gives little or no effect to the drawing direction of the subsequently flying ink, i.e., a range of electric charge in which neither attraction nor repulsion acts too much. This region was determined experimentally by a printing test and organoleptically by a number of persons (30 persons). As a result, this region, as represented in terms of time $\tau$, has been found to be from half to 100 times the relaxation time $\tau$ represented by the product of the dielectric constant $\in$ of the ink and the volume resistivity $\rho$ of the ink as shown in FIG. 4.

The dielectric constant e and volume resistivity $\rho$ of an ink are influenced by the temperature of the atmosphere in the apparatus during the operation of ink jet recording, i.e., temperature of the atmosphere during the operation of ink jet recording or temperature of the ink during the operation of ink jet recording. Thus, in the method according to the present invention, the ink flying period T can be predetermined such that the relaxation time $\tau$ calculated by multiplying the dielectric constant $\in$ of the ink by the volume resistivity $\rho$ at the working temperature at which the ink jet recording process operates is in the range of 0.01 to 2 times the ink flying period T. In such an arrangement, the effect of a preceding dot on the subsequent dot can be suppressed to an extent such that it is substantially unperceivable by human eyes. In other words, an ink from which a dot is formed can be allowed to fly in the proper direction without being influenced by the preceding dot.

Referring to the ink temperature during the operation of ink jet recording, recording may need to operate at an atmosphere temperature in an apparatus of near 0° C. in an early stage after the ink jet recording apparatus is powered on in the winter season in cold locations. On the other hand, taking into account the fixability of the ink, the atmosphere temperature in the apparatus may be predetermined to a value higher than the ambient temperature, occasionally near 100° C. Thus, it is preferable to consider the ink temperature during the operation of ink jet recording in the range of 0° to 100° C.

The ink flying period T is predetermined taking into account the printing speed and resolving power of the ink jet recording apparatus. In general, it can be predetermined on the basis of the surface tension of a flying ink, the time required for drawing back as determined by the distance between the recording head and the recording medium or intermediate recording material, the response time of the electrical drive circuit, etc. The ink flying period T is, for example, preferably 0.01 ms (high speed, high resolution)–1.0 S(low speed, low resolution) and more preferably 0.1 ms–100 ms for an on-demand type system in which ink is injected according to an existence of image symbol, although the ink flying period T is based on a number of nozzles.

An important factor of the implementation of the ink jet recording method according to the present invention is how the charge condition of an ink dot formed by an ink which has flown onto the recording medium or intermediate recording material affects the drawing direction of subsequently flying ink. Therefore, it is important that the relaxation time $\tau$ of an ink which has flown onto the recording medium or intermediate recording material be in the range of 0.01 to 2 times at least the subsequent one ink flying period T.

In the ink jet recording method according to the present invention, the relaxation time $\tau$ of the ink used is possibly kept to 0.01 to 2 times the ink flying period T by the following methods:

i) changing the relaxation time $\tau$ of the ink used with respect to a predetermined ink flying period T, i.e., changing the dielectric constant $\epsilon$ and/or volume resistivity $\rho$ of the ink used, whereby the relaxation time $\tau$ of the ink is kept to 0.01 to 2 times the ink flying period T;

ii) controlling the temperature of an ink which has jetted through an orifice in the recording head and then adhered to the recording medium or intermediate recording material by means of a temperature controlling means provided on the side of the recording medium or intermediate recording material for controlling the surface temperature thereof with respect to a predetermined ink flying period T, taking into account the fact that the volume resistivity $\rho$ of the ink used greatly depends on the temperature thereof, whereby the relaxation time $\tau$ of the ink is kept to 0.01 to 2 times the ink flying period T;

iii) changing the ink flying period T with respect to a predetermined relaxation time $\tau$ of the ink used on which the drive timing and circuit constant are determined, whereby the relaxation time $\tau$ of the ink is kept to 0.01 to 2 times the ink flying period T; and iv) (i), (ii) and (iii) in combination, whereby the relaxation time $\tau$ of the ink is kept to 0.01 to 2 times the ink flying period T.

The ink for ink jet recording which can be preferably used in the implementation of the ink jet recording method in accordance with the method (i) exhibits a dielectric constant $\epsilon$ of from $8.85\times10^{-12}$ to $8.85\times10^{-11}$ C/V.m and a volume resistivity $\rho$ of from $10^4$ to $10^{12}$ $\Omega$m at the ink temperature during the operation of ink jet recording, preferably 0° to 100° C. By selecting an ink having a dielectric constant $\epsilon$ and a volume resistivity $\rho$ in such a range as an ink for ink jet recording, the ink flying period T can be selected from a wide range, thus providing a greater tolerance for design of the recording head. Further, an drawing ink thread can be stably formed. Moreover, discharge can hardly occur.

The preparation of such an ink for ink jet recording can be accomplished preferably by incorporating a proper electrically conductive substance and/or a surface active agent in an ink composition so that the volume resistivity $\rho$ of the ink is mainly changed.

The ink composition to be used herein is not specifically limited. For example, inks such as oil ink and aqueous ink may be used. A so-called hot-melt ink which stays solid at room temperature but is adapted to fly in a hot-molten form can be preferably used from the standpoint of high quality and definition in printing on an ordinary paper.

Taking such a hot-melt ink as an example, the ink composition will be further described hereinafter. As the ink itself there may be used a known ink composition. For example, an ink composition comprising an oil-soluble dye such as black, red, cyan, magenta, yellow dyes and other various color dyes, an aliphatic acid for dissolving or dispersing such an oil-soluble dye therein, an organic solvent such as polyethylene or mixture thereof, an oxidation inhibitor, a preservative, a polymerization inhibitor, etc. may be used.

Examples of such an electrically conductive substance which can be incorporated to adjust the relaxation time $\tau$ of the ink composition include electrically conductive carbon substances which can be incorporated in black inks, such as carbon black and graphite, electrically conductive metal substances such as gold powder, silver powder, platinum powder, nickel powder and copper powder, electrically conductive metal oxide substances such as tin oxide powder and indium oxide powder, and organic electrically conductive substances such as aliphatic metal salt represented by soap.

Preferred examples of the surface active agent which can be used with such an electrically conductive substance include cationic surface active agents such as quaternary ammonium salt represented by stearyldimethylbenzylammonium chloride, anionic surface active agents such as alkylsulfonate represented by Duponol 189 available from Du Pont, alkylsulfonic acid and phosphate, and nonionic surface active agents represented by polyoxyethylene alkylamine.

The amount of the electrically conductive substance or surface active agent which can be incorporated to adjust the relaxation time $\tau$ of the ink composition is not specifically limited. It may be in any range so far as it provides the ink composition with a predetermined relaxation time $\tau$, particularly a predetermined volume resistivity $\rho$, without impairing the required physical properties of the ink composition. The additives of electrically conductive substance and/or surface active agent are preferably incorporated into the ink composition in an amount of 0.05 to 50 wt % and more preferably 1.0 to 30 wt %. These electrically conductive substances or surface active agents may be used singularly or in admixture.

Figure 5:
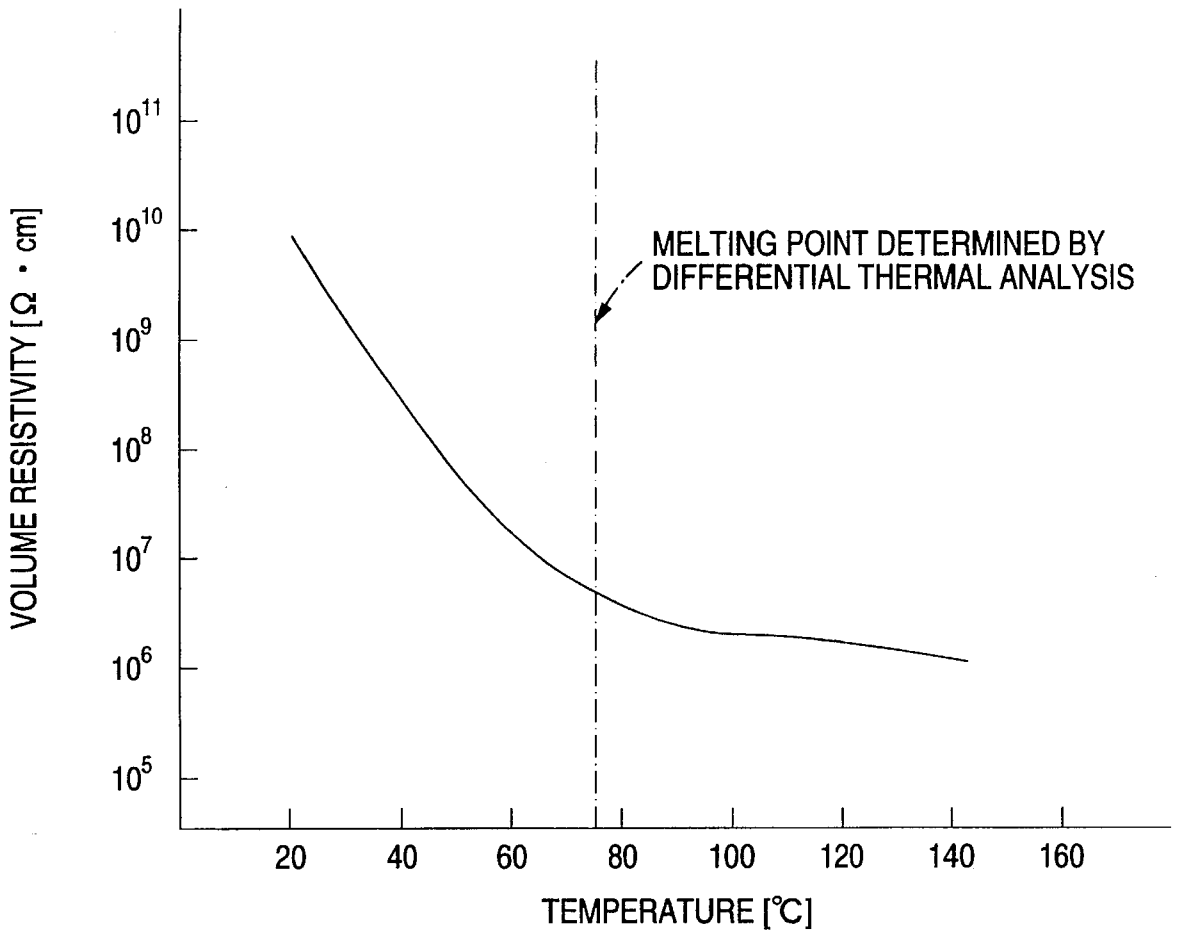
FIG. 5 is a graph illustrating the temperature dependence of the volume resistivity of a polyethylene waxbased hot-melt ink.

In the implementation of the ink jet recording method of the present invention according to the method (ii), it is preferred that the surface temperature of the recording medium or intermediate recording material be controlled to 30° to 200° C., preferably 50° to 100° C., by means of a temperature controlling means provided on the recording medium or intermediate recording material. The volume resistivity $\rho$ of the ink composition tends to show a drastic drop with the rise in the temperature thereof. For example, a polyethylene wax-based hot-melt ink having the composition as set forth in Example 1 hereinafter shows a change in volume resistivity $\rho$ as shown in FIG. 5. In the ink jet recording method of the present invention, the temperature dependence of the volume resistivity $\rho$ of the ink composition can be advantageously utilized.

In the ink jet recording method of the present invention, an ink is allowed to fly for the formation of an ink dot in such a manner that the relaxation time of the ink is in the range of 0.01 to 2 times the ink flying period during the operation of ink jet recording so that the preceding ink dot neither repels nor attracts the flying ink drop. Thus, every dot can be properly positioned in its predetermined position on the recording medium or intermediate recording material, preventing the deterioration of the quality of the image thus formed.

Further, an ink for ink jet recording having a dielectric constant of from $8.85\times10^{-12}$ to $8.85\times10^{-11}$ C/V.m and a volume resistivity of from $10^4$ to $10^{12}$ Ωm at the working temperature at which ink jet recording operates exhibits an extremely short relaxation time as determined by multiplying dielectric constant by volume resistivity. The relaxation time τ of such an ink can be easily controlled to a range of 0.01 to 2 times the ink flying period. Thus, an ink jet recording apparatus for implementing the method of the present invention can be easily designed.

The present invention will be further described in the following examples and comparative examples, but the present invention should not be construed as being limited thereto.

EXAMPLE 1

Figure 6:
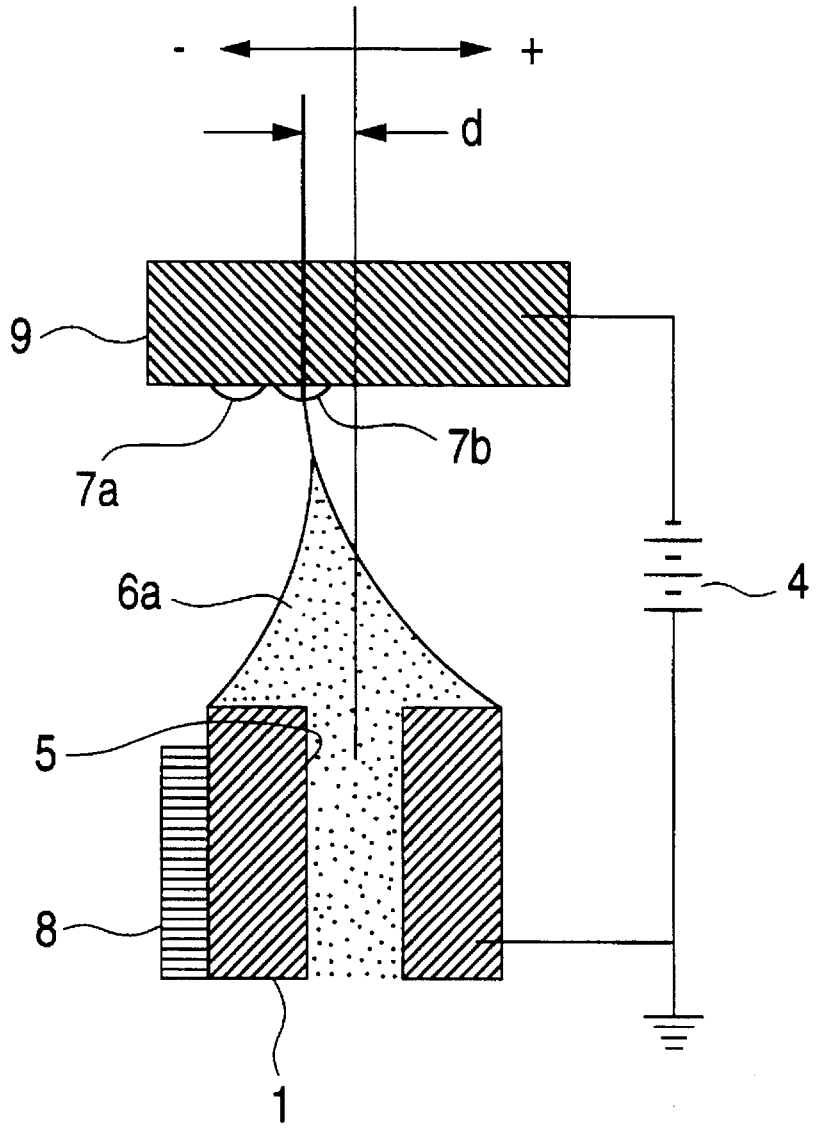
FIG. 6 illustrates an electrostatic attracting-type ink jet recording test apparatus used in an example of the present invention.

As shown in FIG. 6, a heater 8 was mounted on an orifice 5 in a recording electrode 1 formed by polishing the end of a stainless steel capillary tube. The heater 8 was controlled by a temperature controlling system, not shown. An electrically conductive intermediate recording material was positioned opposed to the recording electrode 1. A power supply 4 was connected across the recording electrode 1 and the intermediate recording material 9 so that a voltage pulse can be applied across the two electrodes. In this arrangement, an ink jet recording test apparatus was set up.

On the other hand, a straight-chain polyethylene wax (OA2: trade name of polyethylene wax oxide available from BASF) was blended with 6% by weight of carbon black (R330: trade name of carbon black available from Cabot) and 4% by weight of an alkyl trimethylammonium chloride (A-rquard 12: trade name of alkyl trimethylammonium chloride available from Armour and Co.) as a surface active agent. The mixture was then stirred at a temperature of 80° C. by means of a ball mixer for 10 minutes to prepare a hot-melt ink *6a*.

The hot-melt ink thus prepared was then measured for dielectric constant ∈ and volume resistivity ρ at a temperature of 25° C. As a result, the dielectric constant ∈ was $2\times10^{-11}$ C/V.m and the volume resistivity ρ was $5\times10^9$ Ωm. The relaxation time as calculated from these values was 0.1 second.

The orifice 5 in the foregoing test apparatus was filled with the hot-melt ink *6a* thus prepared. The hot-melt ink *6a* was then hot-molten at a temperature of 110° C. while a 1.8 kv voltage pulse was applied across the recording electrode 1 and the intermediate recording material 9 so that the ink *6a* was allowed to fly to form an ink dot on the intermediate transfer material 9. In this process, the surface temperature of the intermediate recording material 9 was the same as room temperature (25° C.).

Figure 7:
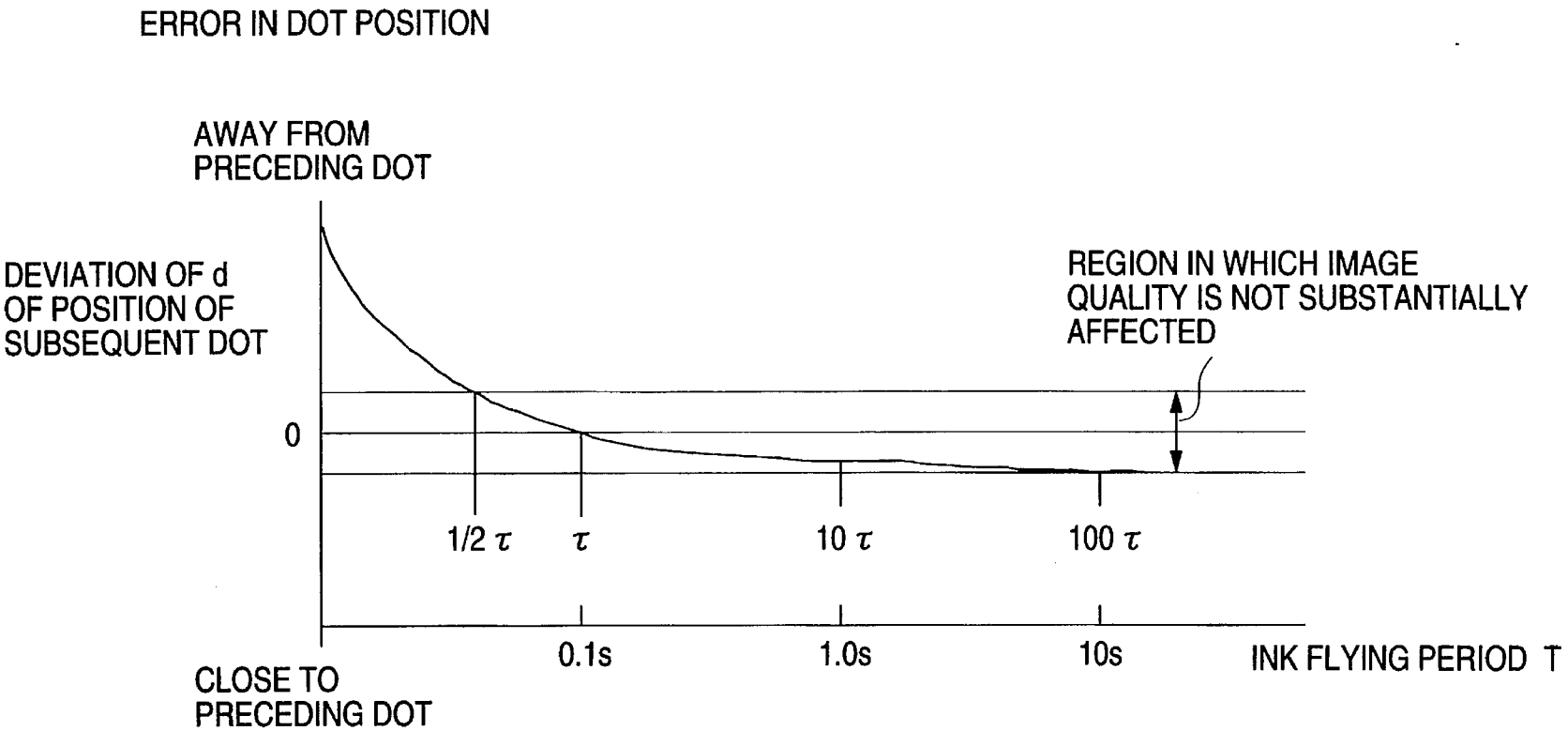
FIG. 7 is a graph illustrating the relationship between the flying period T of an ink obtained in Example 1 and the deviation d of the subsequent dot position.

During this operation, the period T of voltage pulse between the time at which a dot *7a* has been formed and the time at which a subsequent dot *7b* is formed (i.e., printing period or ink flying period) was varied from 1 ms to 480 S to determine the deviation d of the drawing direction of the ink *6a* for the subsequent dot *7b* (i.e., deviation d of the position of the subsequent dot). The results are shown in FIG. 7. (In Example 1, τ=0.1 S and thus 10 τ=1.0 S and 100 τ=10 S).

In the present example, a region where the deviation d of the drawing direction of the ink *6a* has no substantial effects on the image quality was observed. As plotted in FIG. 7, this region is in the range of half to 100 times the relaxation time τ of the ink *6a* (0.1 sec.).

EXAMPLE 2

An oil solvent KMC113 available from Kureha Chemical Industry Co., Ltd. as a base was blended with 6% by weight of carbon black (R330: trade name of carbon black available from Cabot) to prepare an oil ink having a dielectric constant ∈ of $2\times10^{-11}$ C/V.m and a volume resistivity τ of $5\times10^9$ Ωm. This oil ink thus exhibited a relaxation time of 0.1 second as calculated from these properties. This relaxation time was the same as obtained in Example 1. The oil ink thus obtained was then measured for the relationship between the ink flying period T and the deviation d of the subsequent dot position to determine the relationship with the relaxation time. The results are shown in FIG. 8.

Figure 8:
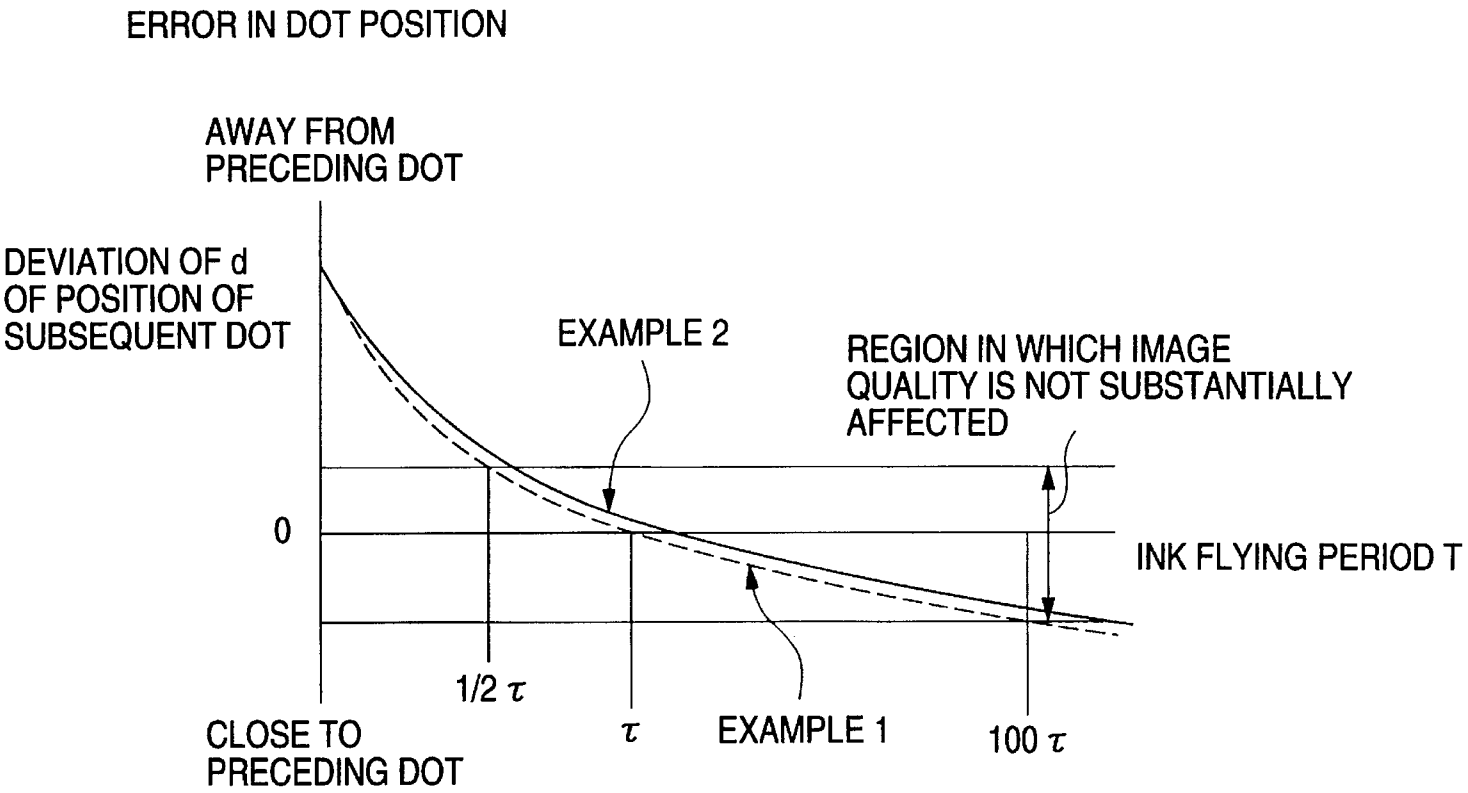
FIG. 8 is a graph illustrating the relationship between the flying period T of an ink obtained in Example 2 and the deviation d of the subsequent dot position.

The results shown in FIG. 8 demonstrate that the oil ink of Example 2 exhibits almost the same results as the hot-melt ink *6a* of Example 1.

EXAMPLE 3

The relationship between the ink flying period T and the deviation d of the subsequent dot position was measured to determine the relationship with the relaxation time in the same manner as in Example 1 except that carbon black was further added to the hot-melt ink of Example 1 so that the total amount of carbon black was 12% by weight.

Figure 9:
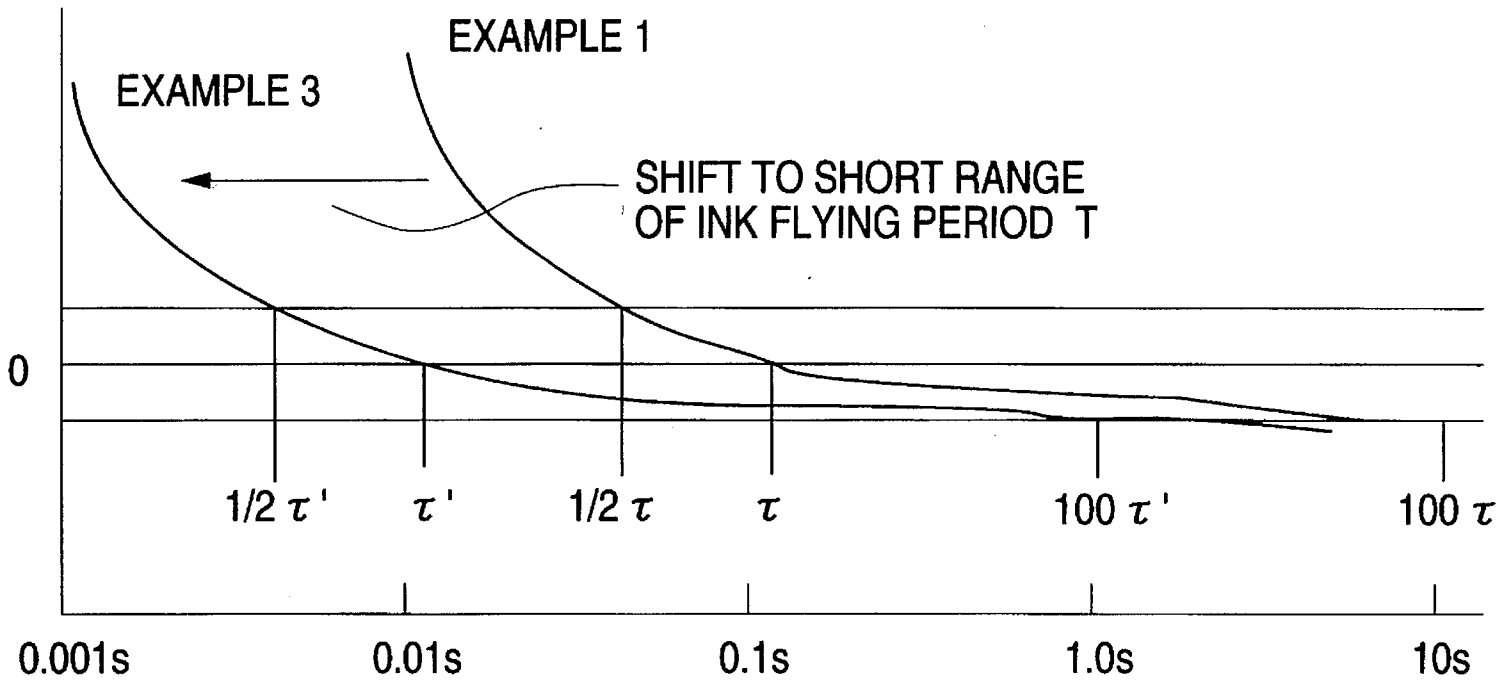
FIG. 9 is a graph illustrating the relationship between the flying period T of an ink obtained in Example 3 and the deviation d of the subsequent dot position.

The results are shown in FIG. 9.

The hot-melt ink thus obtained exhibited a dielectric constant ∈ of $2\times10^{-11}$ C/V.m and a volume resistivity τ of $5\times10^8$ Ωm. The relaxation time calculated from these values was 10 milliseconds, about one tenth (0.1/0.01 (τ/τ')) Of that in Example 1. Thus, the region in which the deviation d of the drawing direction of the ink has no substantial effects on the image quality has shifted to a wavelength range about ten times shorter than that in Example 1. This means that ink flying is carried out more times in a shorter period than in Example 1.

EXAMPLE 4

The relationship between the ink flying period T and the deviation d of the subsequent dot position was measured to determine the relationship with the relaxation time in the same manner as in Example 1 except that tin oxide powder was added to the hot-melt ink of Example 1 in an amount of 2% by weight.

The hot-melt ink thus obtained exhibited a dielectric constant ∈ of $2\times10^{-11}$ C/V.m and a volume resistivity ρ of $5\times10^8$ Ωm. The relaxation time calculated from these values was 10 milliseconds, about one tenth of that in Example 1. Thus, the region in which the deviation d of the drawing direction of the ink has no substantial effects on the image quality has shifted to a wavelength range about ten times shorter than that in Example 1.

EXAMPLE 5

The relationship between the ink flying period T and the deviation d of the subsequent dot position was measured to determine the relationship with the relaxation time in the same manner as in Example 1 except that indium oxide powder was added to the hot-melt ink of Example 1 in an amount of 10% by weight.

The hot-melt ink thus obtained exhibited a dielectric constant ∈ of $2\times10^{-11}$ C/V.m and a volume resistivity ρ of $5\times10^6$ Ωm. The relaxation time calculated from these values was 100 microseconds, about one thousandth of that in Example 1. Thus, the region in which the deviation d of the drawing direction of the ink has no substantial effects on the image quality has shifted to a wavelength range about 1,000 times shorter than that in Example 1.

EXAMPLE 6

The relationship between the ink flying period T and the deviation d of the subsequent dot position was measured to determine the relationship with the relaxation time in the same manner as in Example 1 except that a cationic surface active agent powder was added to the hot-melt ink of Example 1 in an amount of 4% by weight.

The hot-melt ink thus obtained exhibited a dielectric constant $\in$ of $2\times10^{-11}$ C/V.m and a volume resistivity $\rho$ of $5\times10^{8}$ $\Omega$m. The relaxation time calculated from these values was 0.01 seconds, about one tenth of that in Example 1. Thus, the region in which the deviation d of the drawing direction of the ink has no substantial effects on the image quality has shifted to a wavelength range about ten times shorter than that in Example 1.

EXAMPLE 7

The relationship between the ink flying period T and the deviation d of the subsequent dot position was measured to determine the relationship with the relaxation time in the same manner as in Example 1 except that aluminum stearate was added to the oil ink of Example 2 in an amount of 8% by weight.

The oil ink thus obtained exhibited a dielectric constant $\in$ of $2\times10^{-11}$ C/V.m and a volume resistivity $\rho$ of $5\times10^{6}$ $\Omega$m. The relaxation time calculated from these values was 0.1 milliseconds, about one thousandth of that in Example 1. Thus, the region in which the deviation d of the drawing direction of the ink has no substantial effects on the image quality has shifted to a wavelength range about 1,000 times shorter than that in Example 1.

EXAMPLE 8

The relationship between the ink flying period T and the deviation d of the subsequent dot position was measured to determine the relationship with the relaxation time in the same manner as in Example 1 except that a quaternary ammonium salt of tetraalkyl as a cationic surface active agent was added to the oil ink of Example 2 in an amount of 4% by weight.

The oil ink thus obtained exhibited a dielectric constant $\in$ of $2\times10^{-11}$ C/V.m and a volume resistivity $\rho$ of $5\times10^{6}$ $\Omega$m. The relaxation time calculated from these values was 0.1 milliseconds, about one thousandth of that in Example 1. Thus, the region in which the deviation d of the drawing direction of the ink has no substantial effects on the image quality has shifted to a wavelength range about 1,000 times shorter than that in Example 1.

EXAMPLE 9

The relationship between the ink flying period T and the deviation d of the subsequent dot position was measured to determine the relationship with the relaxation time in the same manner as in Example 1 except that a higher secondary alkylsulfonate (MP189 available from Du Pont) as an anionic surface active agent was added to the oil ink of Example 2 in an amount of 3% by weight.

The oil ink thus obtained exhibited a dielectric constant $\in$ of $2\times10^{-11}$ C/V.m and a volume resistivity $\rho$ of $5\times10^{7}$ $\Omega$m. The relaxation time calculated from these values was 1 millisecond, about one hundredth of that in Example 1. Thus, the region in which the deviation d of the drawing direction of the ink has no substantial effects on the image quality has shifted to a wavelength range about 100 times shorter than that in Example 1.

EXAMPLE 10

The relationship between the ink flying period T and the deviation d of the subsequent dot position was measured to determine the relationship with the relaxation time in the same manner as in Example 1 except that tin oxide powder was added to the oil ink of Example 2 in an amount of 10% by weight.

The oil ink thus obtained exhibited a dielectric constant $\in$ of $2\times10^{-11}$ C/V.m and a volume resistivity $\rho$ of $5\times10^{6}$ $\Omega$m. The relaxation time calculated from these values was 0.1 seconds, about one thousandth of that in Example 1. Thus, the region in which the deviation d of the drawing direction of the ink has no substantial effects on the image quality has shifted to a wavelength range about 1,000 times shorter than that in Example 1.

EXAMPLE 11

The relationship between the ink flying period T and the deviation d of the subsequent dot position was measured to determine the relationship with the relaxation time in the same manner as in Example 1 except that indium oxide powder was added to the oil ink of Example 2 in an amount of 10% by weight.

The oil ink thus obtained exhibited a dielectric constant $\in$ of $2\times10^{-11}$ C/V.m and a volume resistivity $\rho$ of $5\times10^{6}$ $\Omega$m. The relaxation time calculated from these values was 0.1 milliseconds, about one thousandth of that in Example 1. Thus, the region in which the deviation d of the drawing direction of the ink has no substantial effects on the image quality has shifted to a wavelength range about 1,000 times shorter than that in Example 1.

EXAMPLE 12

A heater (not shown) and a temperature controlling apparatus for detecting the surface temperature of the intermediate transfer material 9 to control the operation of the heater were installed on the back side of the intermediate transfer material 9 in the test apparatus of FIG. 6 used in Example 1. With the same hot-melt ink as used in Example 1, the relationship between the ink flying period T and the deviation d of the subsequent dot position was measured while the surface temperature of the intermediate transfer material 9 was kept to 80° C. to determine the relationship with the relaxation time in the same manner as in Example 1.

The hot-melt ink exhibited a dielectric constant $\in$ of $2\times10^{-11}$ C/V.m and a volume resistivity $\rho$ of $5\times10^{6}$ $\Omega$m at a temperature of 80° C. The relaxation time calculated from these values was 0.1 milliseconds, about one thousandth of that in Example 1. Thus, the region in which the deviation d of the drawing direction of the ink has no substantial effects on the image quality has shifted to a wavelength range about 1,000 times shorter than that in Example 1.

In accordance with the electrostatic attracting-type ink jet recording method according to the present invention, an ink dot which has adhered to the recording medium or intermediate recording material can be prevented from affecting the drawing direction of the subsequently flying ink as much as possible. Thus, the ink can be always allowed to fly onto a proper position to form an image with a high quality.

The ink for ink jet recording according to the present invention has an extremely short relaxation time and thus is useful in the ink jet recording method of the present invention which comprises the formation of an image with a high quality by invariably allowing an ink to fly onto a proper position.

While the invention has been described in detail and with reference to specific embodiments thereof, it will be apparent to one skilled in the art that various changes and modifications can be made therein without departing from the spirit and scope thereof.

What is claimed is:

1. An electrostatic attracting-type ink jet recording method comprising the steps of:

applying a voltage pulse across a recording electrode connected to a recording head and an opposition electrode disposed on an opposite side of a recording medium or intermediate recording material, whereby a resulting Coulomb's force causes ink to jet for a period onto said recording medium or intermediate recording material through an orifice in said recording head to record an image thereon; and maintaining a relaxation time of said ink, said relaxation time being equal to a dielectric constant of said ink multiplied by a volume resistivity of said ink during said ink jet recording in a range of 0.01 to 2 times said jetting period of said ink.

2. The ink jet recording method as claimed in claim 1, wherein said ink jet recording process is a hot melt process by which a thermoplastic ink, which stays solid at room temperature is hot-molten and jetted.

3. The ink jet recording method as claimed in claim 1, wherein the relaxation time of a first ink drop which has jetted and adhered to said recording medium or intermediate recording material is in the range of 0.01 to 2 times the jetting period of at least a second ink drop which jets after adhesion of the first ink drop to said recording medium or intermediate recording material.

4. The ink jet recording method as claimed in claim 1, wherein a temperature controlling means for controlling a surface temperature of said recording medium or intermediate recording material is provided in thermal contact with the recording medium or intermediate recording material, whereby a temperature of an ink which has jetted through said orifice in said recording head and adhered to said recording medium or intermediate recording material is maintained at 30° to 200° C. during at least a subsequent ink jetting period.

5. The ink jet recording method as claimed in claim 1, wherein the dielectric constant and the volume resistivity determining the relaxation time of the ink are respectively from $8.85\times10^{-12}$ to $8.85\times10^{-11}$ C/V.m and from $10^4$ to $10^{12}$ Ωm at a working temperature at which ink jet recording operates.

6. The ink jet recording method as claimed in claim 1, wherein the relaxation time of the ink calculated by multiplying the dielectric constant by the volume resistivity is controlled by changing the volume resistivity of the ink by adding to said ink at least one member selected from the group consisting of an inorganic electrically conductive substance, an organic electrically conductive substance and a surface active agent.

* * * * *